US011511956B2

(12) United States Patent
Okamoto et al.

(10) Patent No.: US 11,511,956 B2
(45) Date of Patent: Nov. 29, 2022

(54) SHEET CONVEYER

(71) Applicant: Brother Kogyo Kabushiki Kaisha, Nagoya (JP)

(72) Inventors: Yoshihiro Okamoto, Komaki (JP); Tomoyuki Mizuno, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 107 days.

(21) Appl. No.: 17/081,525

(22) Filed: Oct. 27, 2020

(65) Prior Publication Data

US 2021/0122594 A1 Apr. 29, 2021

(30) Foreign Application Priority Data

Oct. 28, 2019 (JP) ..... JP2019-195426

(51) Int. Cl.
*B65H 3/06* (2006.01)
*B65H 1/14* (2006.01)
*B65H 7/04* (2006.01)

(52) U.S. Cl.
CPC ..... *B65H 3/0669* (2013.01); *B65H 1/14* (2013.01); *B65H 3/0638* (2013.01); (Continued)

(58) Field of Classification Search
CPC ..... B65H 1/08; B65H 1/14; B65H 3/0669; B65H 3/0684; B65H 3/5223; B65H 7/02; B65H 7/04; B65H 7/18; B65H 2404/1521; B65H 2405/1117; B65H 2405/324; B65H 2511/18; B65H 2511/515; B65H 2513/104; B65H 2515/82; B65H 2601/521
See application file for complete search history.

(56) References Cited

U.S. PATENT DOCUMENTS 6,091,927 A 7/2000 Hattori et al.
2005/0051944 A1* 3/2005 Makino ..... B65H 5/062 271/10.01

(Continued)

FOREIGN PATENT DOCUMENTS

JP H01-143729 U 10/1989
JP H09-166831 A 6/1997
JP H11-199065 A 7/1999

*Primary Examiner* — Prasad V Gokhale
(74) *Attorney, Agent, or Firm* — Banner & Witcoff, Ltd.

(57) ABSTRACT

A sheet conveyer having a sheet tray, a tray-driving mechanism, a conveyance guide, a feed roller, a separator, a conveyer, a conveyer-driving mechanism, a controller, and a sheet sensor to detect sheets on the sheet tray, is provided. The conveyer-driving mechanism includes a transmission-active portion and a transmission-passive portion. A conveying velocity to convey the sheets by the conveyer is higher than a conveying velocity to convey the sheets by the feed roller and the separator. The transmission-active portion and the transmission-passive portion are rotatable about a transmission axis. The transmission-passive portion rotates passively by being pushed by the transmission-active portion. After the sheet sensor detects absence of the sheets, and before the transmission-passive portion starts rotating passively, the controller conducts a specific action to move the sheet tray downward by controlling the tray-driving mechanism.

6 Claims, 7 Drawing Sheets

(52) U.S. Cl.
CPC ..... *B65H 3/0676* (2013.01); *B65H 3/0684* (2013.01); *B65H 7/04* (2013.01); *B65H 2403/42* (2013.01); *B65H 2404/1521* (2013.01); *B65H 2405/111643* (2013.01); *B65H 2405/324* (2013.01); *B65H 2511/18* (2013.01); *B65H 2513/104* (2013.01); *B65H 2601/521* (2013.01)

(56) References Cited

U.S. PATENT DOCUMENTS

2011/0241285 A1* 10/2011 Sekiguchi ..... B65H 1/266 271/162
2014/0084531 A1* 3/2014 Fukumoto ..... B65H 5/021 271/10.1

* cited by examiner

SHEET CONVEYER

CROSS REFERENCE TO RELATED APPLICATION

This application claims priority from Japanese Patent Application No. 2019-195426, filed on Oct. 28, 2019, the entire subject matter of which is incorporated herein by reference.

BACKGROUND

Technical Field

An aspect of the present disclosure is related to a sheet conveyer.

Related Art

A sheet feeder, or a document feeder, for example, having a document placement table, a conveyance guide, a feeder belt, a separator roller, a conveyer roller, and a controller, is known. The original placement table may support original sheets to be fed inside. The conveyance guide may guide the original sheets fed from the document placement table to convey further inward. The controller may operate a solenoid to move a bottom plate on the document placement table vertically to lift or lower the original document. Moreover, the controller may drive the feeder belt and the conveyer roller.

The feeder belt may contact leading edges of the original sheets and convey the original sheets along the conveyance guide. The separator roller may separate the original sheets from each other. The conveyer roller may convey the separated original sheets passed from the feeder belt one by one further.

The document feeder may further have a sheet sensor and a registration sensor. The sheet sensor may be located between the separator roller and the conveyer roller to detect presence of the original sheet being conveyed. The registration sensor may be located between the conveyer roller and an ejection roller to detect presence of the sheet being conveyed.

The document feeder may move the bottom plate on the original placement table vertically in several occasions. For example, the controller may operate the solenoid to move the bottom plate downward when a trailing end of a final one of the original sheets on the original placement table is fed by the feeder belt and passes through the sheet sensor.

For another example, the controller may move the bottom plate downward and upward repeatedly. In particular, when a leading edge of a separated original sheet passes through the sheet sensor, the controller may move the bottom plate downward, and when a trailing end of the same original sheet passes through the sheet sensor or the registration sensor, the controller may uplift the bottom plate. The controller may repeat the uplifting and lowering control for each original sheet, and after a trailing end of a final one of the original sheets from the original placement table passes through the sheet sensor or the registration sensor, the controller may maintain the bottom plate at the lowered position without uplifting.

Thus, at the lowered position, the bottom plate may be separated from the feeder belt while the final original sheet is being conveyed, and after the final original is completely conveyed, so that the feeder belt in motion may be restrained from being abraded by contacting and rubbing the bottom plate on the original placement table.

SUMMARY

However, in this arrangement of the known document feeder, in which the bottom plate is lowered when the trailing end of the final original sheet being conveyed by the feeder belt passes through the sheet sensor, the feeder belt in motion may continue rubbing on the bottom plate of the original placement table after the trailing edge of the final original sheet leaves the bottom plate until the trailing edge is detected by the sheet sensor. Therefore, it may still be difficult to restrain noise and/or abrasion that may be caused by the feeder belt frictionally sliding on the bottom plate clearly.

Moreover, under the uplifting and lowering control, in which the bottom plate may be moved vertically for each original sheet until the trailing end of the final original sheet passes through the sheet sensor or the registration sensor, friction may still be caused between the original sheets staying motionless on the original placement table and the feeder belt in motion. Therefore, again, it may be difficult to restrain noise and/or abrasion that may be caused by the feeder belt frictionally sliding on the bottom plate clearly.

In this regard, it may be difficult to reduce noise and improve endurance of the document feeder.

The present disclosure is advantageous in that a sheet feeder, in which noise may be reduced, and endurance of which may be improved, is provided.

According to an aspect of the present disclosure, a sheet conveyer, having a sheet tray configured to support sheets for being fed, a tray-driving mechanism configured to move the sheet tray vertically according to a quantity of the sheets supported by the sheet tray, a conveyance guide configured to guide the sheets fed from the sheet tray, a feed roller configured to feed the sheets supported by the sheet tray along the conveyance guide, a separator configured to separate the sheets fed by the feed roller from one another and convey the sheets separately along the conveyance guide, a conveyer configured to convey the sheets passed from the separator, a conveyer-driving mechanism configured to drive the feed roller, the separator, and the conveyer, a controller configured to control the tray-driving mechanism and the conveyer-driving mechanism, and a sheet sensor located between the feed roller and the separator, is provided. The sheet sensor is configured to detect presence and absence of the sheets supported by the sheet tray. The conveyer-driving mechanism includes a transmission-active portion and a transmission-passive portion. The transmission-active portion and the transmission-passive portion are arranged in a path to transmit a driving force from a driving source to the feed roller and the separator. The conveyer-driving mechanism is configured to drive the feed roller, the separator, and the conveyer in a setting such that a conveying velocity to convey the sheets by the conveyer is higher than a conveying velocity to convey the sheets by the feed roller and the separator. The transmission-active portion is configured to be driven to rotate about a transmission axis. The transmission-passive portion is configured to be driven to rotate about the transmission axis. The transmission-passive portion is configured to contact the transmission-active portion along a circumferential direction of the transmission axis. The transmission-passive portion is configured to start rotating passively by being pushed by the transmission-active portion. The controller is configured to, after the sheet sensor detects absence of the sheets supported by the sheet tray, and before the transmission-passive portion starts rotating passively, conduct a specific action to move the sheet tray downward by controlling the tray-driving mechanism.

BRIEF DESCRIPTION OF THE ACCOMPANYING DRAWINGS

DETAILED DESCRIPTION

In the following paragraphs, described with reference to the accompanying drawings will be an embodiment of the present disclosure. It is noted that various connections may be set forth between elements in the following description. These connections in general and, unless specified otherwise, may be direct or indirect and that this specification is not intended to be limiting in this respect. It will be understood that those skilled in the art will appreciate that there are numerous variations and permutations of an image reading apparatus that fall within the spirit and scope of the invention.

Embodiment

Figure 1:
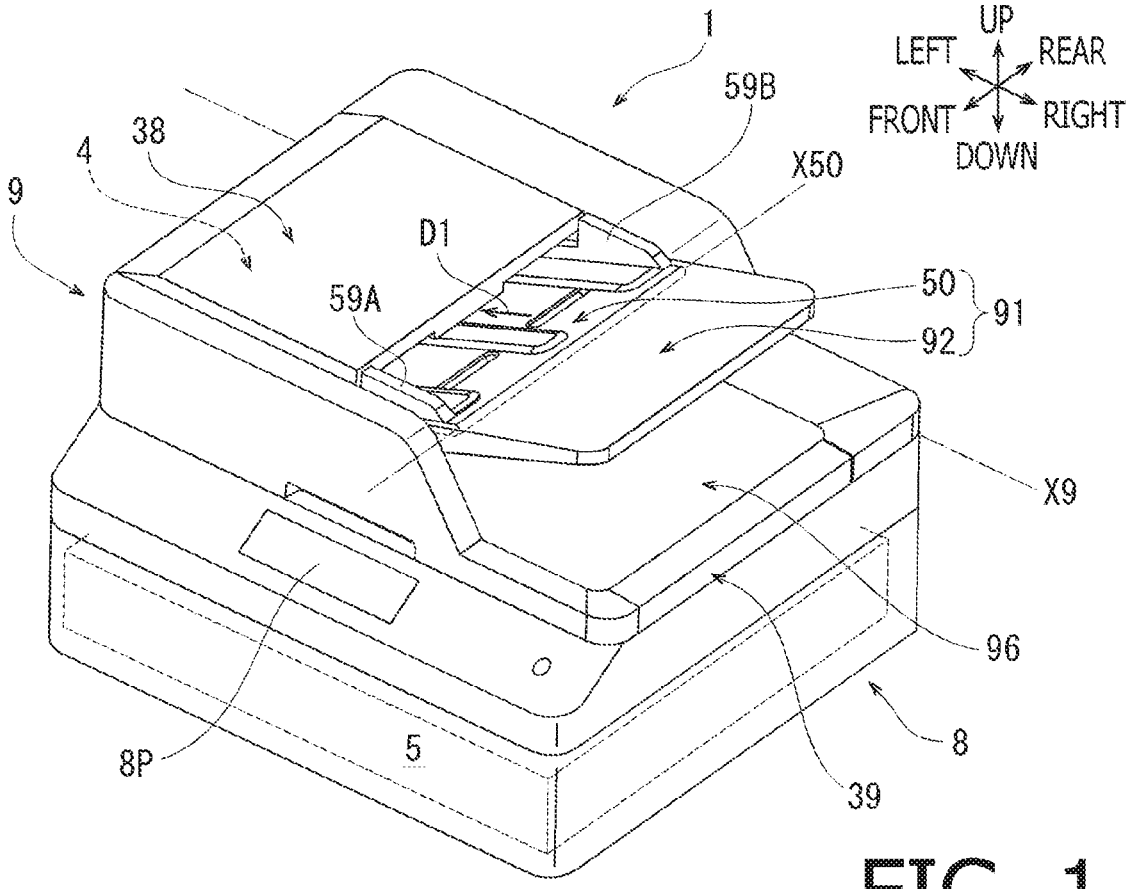
FIG. 1 is a perspective view of an image reading apparatus according to an embodiment of the present disclosure.

FIG. 1 shows an image reading apparatus 1 including a sheet conveyer according to the embodiment of the present disclosure. As shown in FIG. 1, positional relation within the image reading apparatus 1 and each part or item included in the image reading apparatus 1 will be mentioned on basis of the orientation of the image reading apparatus 1 as indicated by arrows in FIG. 1. For example, a side, on which an operation panel 8P is arranged, is defined as a front side of the image reading apparatus 1, and a side opposite to the front side is defined as a rear side. A right-hand side and a left-hand side to a user who faces the front side of the image reading apparatus 1 are defined as a rightward side and a leftward side, respectively. Moreover, a right-to-left or left-to-right direction may be called as a crosswise direction, a front-to-rear or rear-to-front direction may be called as a front-rear direction, and a direction orthogonal to the crosswise direction and to the front-rear direction may be called as an up-down direction or a vertical direction. Furthermore, directions of the drawings in FIGS. 3-6 are similarly based on the orientation of the image reading apparatus 1 as defined above and correspond to those with respect to the image reading apparatus 1 shown in FIG. 1 even when the drawings are viewed from different angles.

<Overall Configuration>

Figure 2:
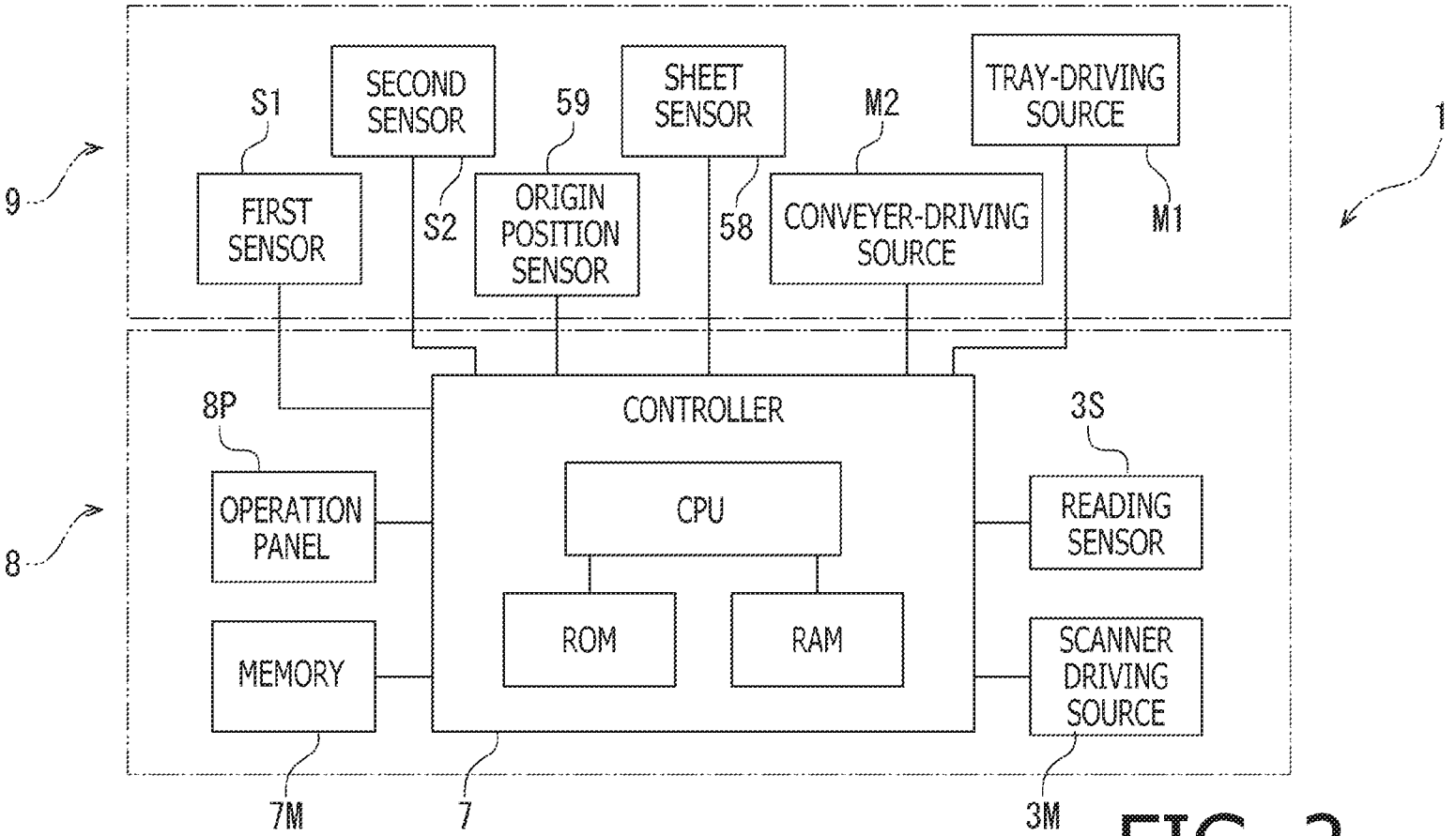
FIG. 2 is a block diagram to illustrate a configuration of the image reading apparatus according to the embodiment of the present disclosure.
Figure 3:
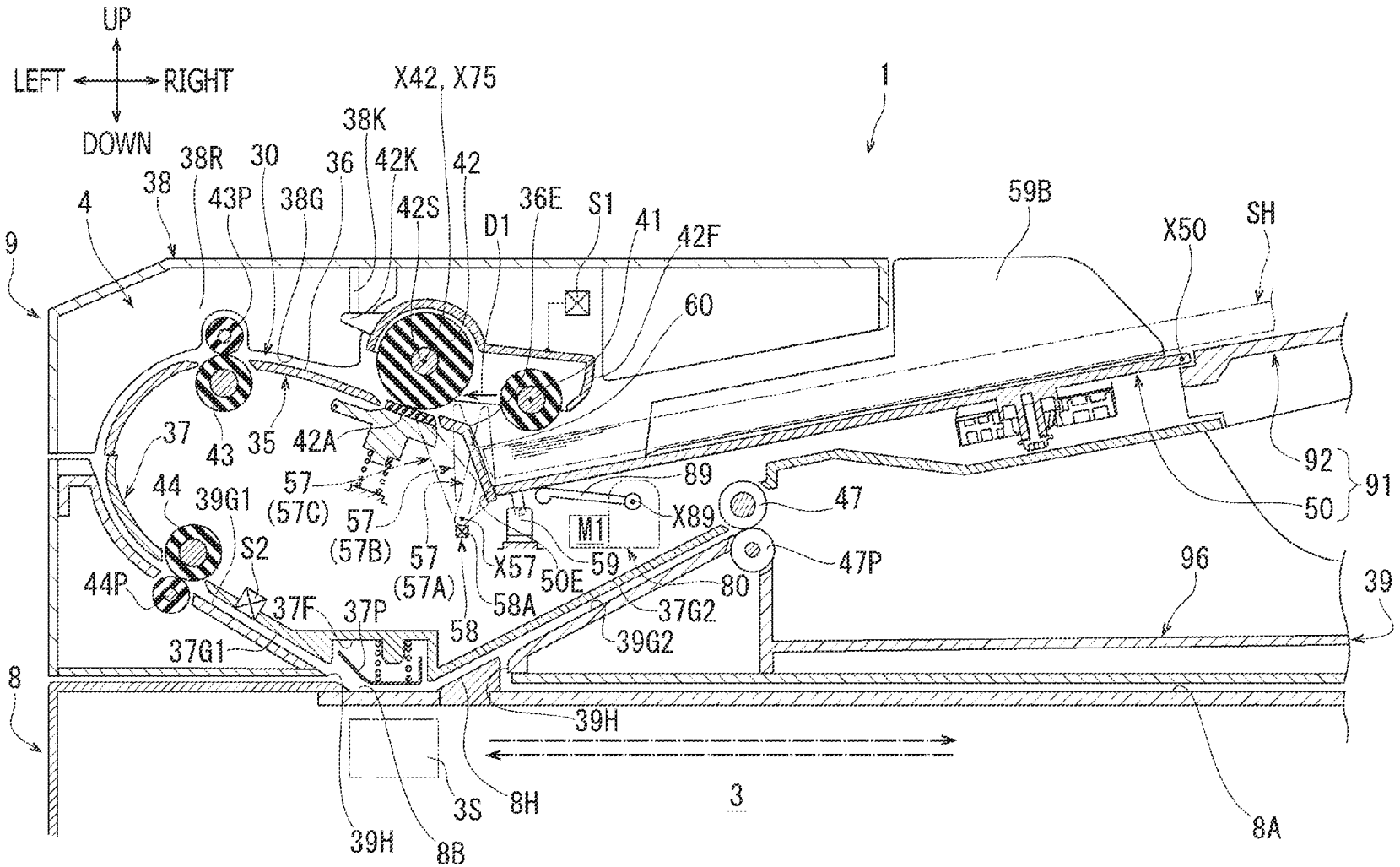
FIG. 3 is a cross-sectional partial view of the image reading apparatus according to the embodiment of the present disclosure, with a movable plate located at an origin position.

As shown in FIGS. 1-3, the image reading apparatus 1 includes a main body 8 and an openable/closable body 9 arranged on top of the main body 8. The main body 8 has an approximate shape of a short rectangular box. On a front side of the main body 8, arranged is the operation panel 8P including a touch panel. In a lower position in the main body 8, stored is an image forming unit 5, which may form an image on a sheet in one of known printing techniques such as inkjet printing and laser printing.

As shown in FIG. 3, in an upper area in the main body 8, arranged is a reader unit 3, which may be used when an image of an original document is read.

Figure 4:
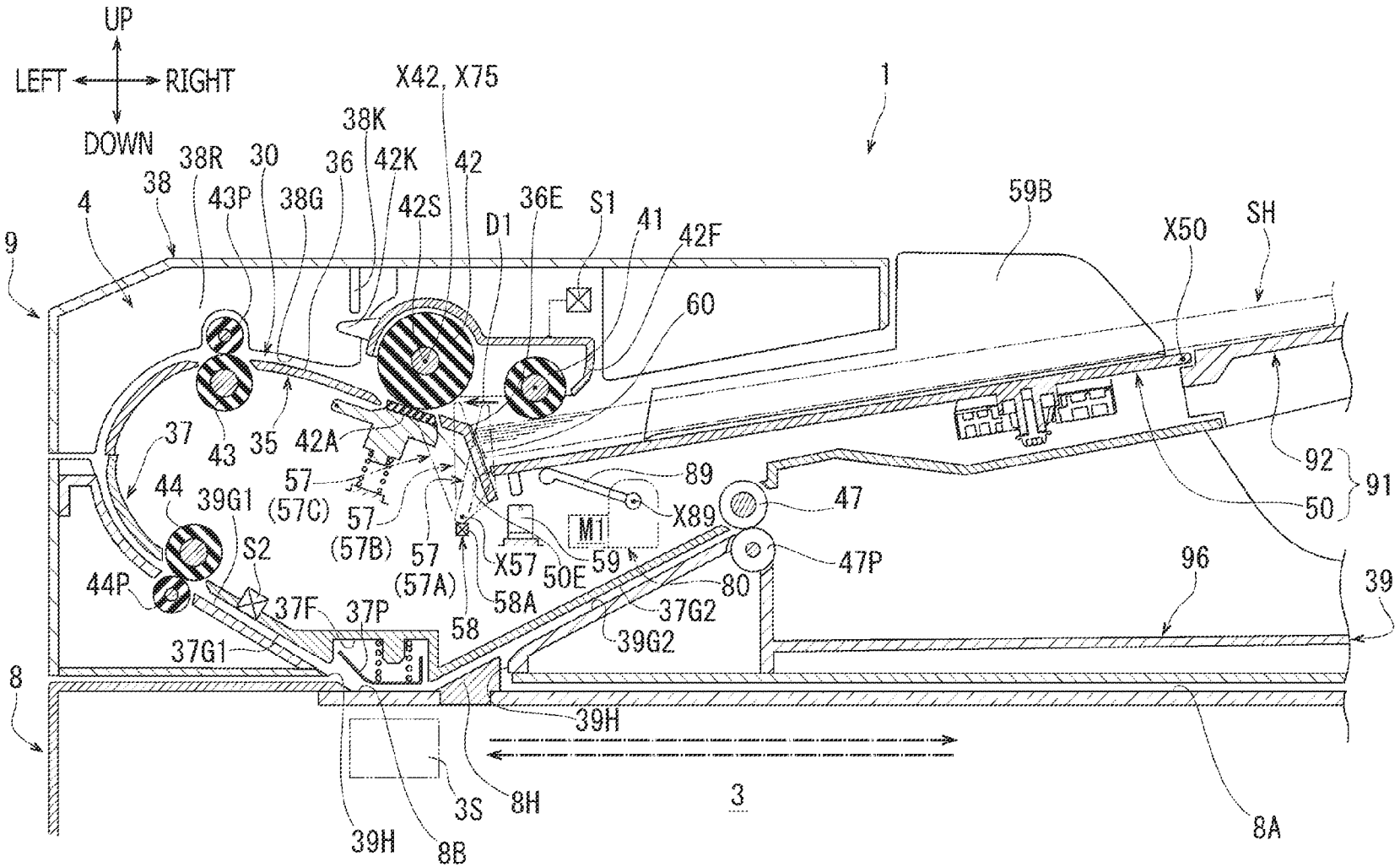
FIG. 4 is another cross-sectional partial view of the image reading apparatus according to the embodiment of the present disclosure, with the movable plate moved from an origin position to a feeding position.
Figure 5:
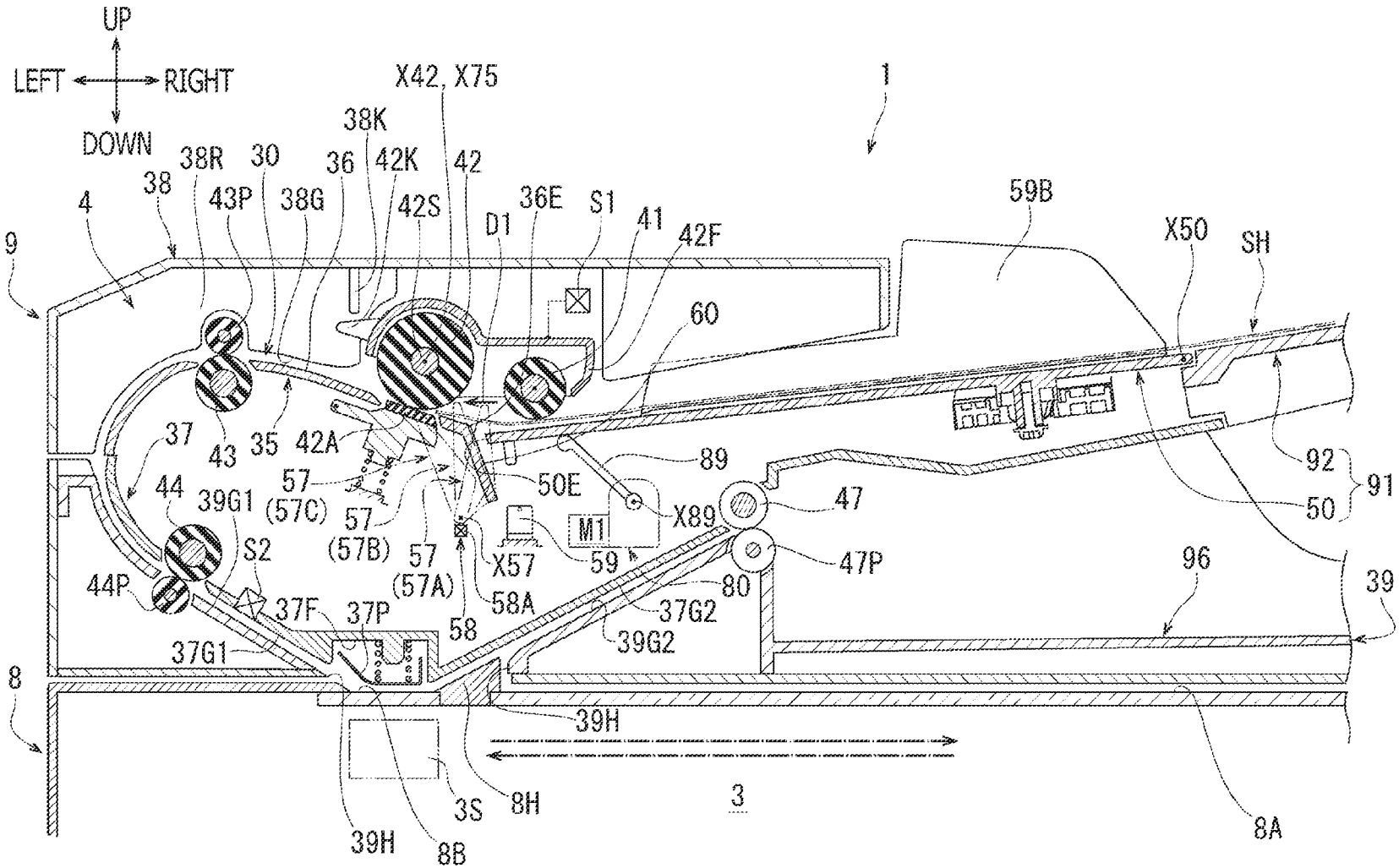
FIG. 5 is another cross-sectional partial view of the image reading apparatus according to the embodiment of the present disclosure, with the movable plate moved upward, as a quantity of remaining sheets lowers, to stay at the feeding position.

In the openable/closable body 9, arranged are a sheet tray 91, an ejection tray 96, and an automatic conveyer 4. The sheet tray 91 and the ejection tray 91 are arranged in a rightward area in the openable/closable body 9. As shown in FIGS. 3-5, the sheet tray 91 supports one or more sheets SH to be fed. The automatic conveyer 4 includes a conveyance guide 30 arranged on a downstream side of the sheet tray 91 in a conveying direction D1 to convey the sheets SH. The conveying direction D1 is a direction for each sheet SH to travel along the conveyance guide 30, leftward from the sheet tray 91, turning downward and rightward in a shape of U at a leftward area in the openable/closable body 9, to reach the ejection tray 96.

The automatic conveyer 4 may be used when the sheets SH supported on the sheet tray 91 are conveyed one by one in the conveying direction D1 along the conveyance guide 30 so that images of the sheets SH being conveyed are read by the reader unit 3 and ejected to rest on the ejection tray 96.

As shown in FIG. 2, the main body 8 stores a controller 7 and a memory 7M therein. The controller 7 includes a microcomputer including, but not limited to, a CPU, a ROM, and a RAM. The ROM may store programs for controlling actions of the image forming apparatus 1 and for executing a variety of processes. The RAM may serve as a memory area to temporarily store data and signals, which may be used by the CPU to run the programs, and as a work area to process data. The controller 7 may control overall acts in the image reading apparatus 1 including the image forming unit 2, the reader unit 3, the automatic conveyer 4, and the operation panel 8P.

The memory 7M is a storage device and may be, for example, a hard disk drive, or a memory card, which may be an external memory device provided separately from the controller 7, or, for another example, a non-volatile memory embedded in the controller 7. The memory 7M may serve as a long-term storage, in which information, data, and setting parameters for executing the programs may be stored in accordance with write-commands from the controller 7, and from which the information may be taken out and passed to the controller 7 according to read-commands from the controller 7.

As shown in FIG. 3, on an upper side of the main body 8, arranged is a platen glass. An upper surface of the platen glass provides a document supporting surface 8A, which occupies a larger area on the upper side of the main body 8. Further, at a leftward position with respect to the document supporting surface 8A on the upper side of the main body 8, arranged is another platen glass. An upper surface of the other platen glass provides a reader surface 8B extending longitudinally in the front-rear direction.

The document supporting surface 8A may support an original document from below when the reader unit 3 reads an image of the original document placed still on the document supporting surface 8A. The original document to be read may include, for example, a sheet, including paper and OHP film, and pages of a book.

The reader surface 8B may contact each of the sheets SH being conveyed one by one by the automatic conveyer 4 from below when the reader unit 3 reads images of the sheets SH. At a position on the upper side of the main body 8 between the document supporting surface 8A and the reader surface 8B, arranged is a guiding protrusion 8H. The guiding protrusion 8H may guide the sheet SH being conveyed on the reader surface 8B to lift from the reader surface 8B and turn upper-rightward.

In the present embodiment, an object, whose image may be read by use of the document supporting surface 8A, may be called as an original document, and an object, whose image may be read while the object is being conveyed by the automatic conveyer 4, may be called as a sheet. An original document and a sheet may be substantially a same object. In other words, an original document may be used as a sheet, and a sheet may be used as an original document.

As shown in FIG. 1, the openable/closable body 9 is swingably supported by hinges, which are not shown but are arranged at a rear end area of the main body 8, to swing about an open/close axis X9 extending in the crosswise direction. When the openable/closable body 9 is at a closed position, as shown in FIG. 3, the openable/closable body 9 covers the document supporting surface 8A and the reader surface 8B from above. Although not shown in the drawings, the openable/closable body 9 may, with a frontward part thereof being moved to swing upper-rearward about the open/close axis 9A, move to an open position, in which the document supporting surface 8A and the reader surface 8B are exposed. With this swingable structure of the openable/closable body 9, the user may place the original document being the object on the document supporting surface 8A.

In the following paragraphs, positional relation within the openable/closable body 9 and each part or item contained in the openable/closable body 9 will be mentioned on basis of the posture of the openable/closable body 9 being at the closed position.

The reader unit 3 includes a reading sensor 3S, which is stored in an upper area in the main body 8, as shown in FIGS. 2 and 3, a scanner-driving source 3M, as shown in FIG. 2, and a scanner device to be driven by the scanner-driving source 3M, which is not shown. The reading sensor 3S may be a known image reading sensor, such as a contact image sensor (CIS) or a charge coupled device (CCD).

As shown in FIG. 3, the reading sensor 3S is located at a lower position with respect to the document supporting surface 8A and the reader surface 8B. The scanner device (not shown) is, in order to read an image of an original document supported on the document supporting surface 8A, driven by the scanner-driving source 3M to move the reading sensor 3S to reciprocate in the crosswise direction in the area underneath the document supporting surface 8A in the main body 8. On the other hand, in order to read an image of a sheet SH being conveyed by the automatic conveyer 4, the scanner device is driven by the scanner-driving source 3M, and the reading sensor 3S is stopped at a position underneath the reader surface 3B in the main body 8 so that the reader 3S staying still may read an image of a sheet SH being conveyed by the automatic conveyer 4. The position where the reading sensor 3S stops underneath the reader surface 3B is a predetermined stationary reading position.

<Configurations of Base Member, First Chute Member, Second Chute Member, and Cover Member>

The openable/closable body 9 includes a base member 39, a first chute member 35, a second chute member 37, and a cover member 38.

The base member 39 forms a bottom part of the openable/closable body 9. A rightward part of the base member 39 forms the ejection tray 96, and in a leftward part of the base member 39, in a range coincident with the reader surface 8B and the guiding protrusion 8H, formed is a rectangular hole 39H.

A leftward part of the base member 39 with respect to the rectangular hole 39H forms a conveyer surface 39G1. A leftward part of the conveyer surface 39G1 curves to change an orientation thereof from downward to lower-rightward and extends to incline lower-rightward to a leftward edge of the rectangular hole 39H.

A rightward part of the base member 39 with respect to the rectangular hole 39H forms a conveyer surface 39G2. The conveyer surface 39G2 inclines upper-rightward from a position adjacent to the guiding protrusion 8H.

The second chute member 37 is arranged at an upper position with respect to the leftward part of the base member 39. The second chute member 37 is formed to have a pressing-member retainer 37F and guiding surfaces 37G1, 37G2.

The pressing-member retainer 37F is a recessed portion formed to recess upward at a position to face the reader surface 8B. The pressing-member retainer 37F retains a pressing member 37P vertically movably. The pressing member 37P may press the sheet SH being conveyed on the reader surface 8B from above and restrain the sheet SH from being separated from the reader surface 8B.

The guiding surface 37G1 is located at a position leftward with respect to the pressing-member retainer 37F. A leftward part of the guiding surface 37G1 curves along the leftward part of the conveyer surface 39G1 in the base member 39. Moreover, the guiding surface 37G1 inclines lower-rightward along the lower-rightward inclination of the conveyer surface 39G1 in the base member 39.

At an intermediate position on the part of the guiding surface 37G1 inclining lower-leftward, arranged is a second sensor S2. The second sensor S2 may detect presence and absence of the sheet SH being conveyed along the conveyance guide 30. When the second sensor S2 is not detecting the presence of the sheet SH, the second sensor S2 may generate and transmit OFF signals being detection signals indicating a detected result to the controller 7. When the second sensor S2 detects a leading edge of the sheet SH being conveyed along the conveyance guide 30, the second sensor S2 may be switched to generate ON signals and transmit the ON signals to the controller 7 until the sheet SH being conveyed passes through the second sensor S2 completely. After the sheet SH being conveyed passes through the second sensor S2 completely, the second sensor S2 may generate and transmit OFF signals being detection signals to the controller 7.

The guiding surface 37G2 is located at a position rightward with respect to the pressing-member retainer 37F. The guiding surface 37G2 inclines upper-rightward along the inclination of the guiding protrusion 8H in the main body 8 and the conveyer surface 39G2 in the base member 39.

The first chute member 35 is arranged at an upper position with respect to the second chute member 37. The first chute member 35 is formed to have a conveyer surface 36 and a restrictive surface 60.

The conveyer surface 36 is located on a downstream side of the sheet tray 91 in the conveying direction D1 and extends upper-leftward. An upstream end of the conveyer surface 36 in the conveying direction D1, i.e., a rightward end of the conveyer surface 36, forms a conveyer edge 36E. A leftward end of the conveyer surface 36 curves to change an orientation thereof from leftward to downward.

The restrictive surface 60 extends downward from the conveyer edge 36E of the conveyer surface 36 in a direction intersecting with the conveying direction D1. The restrictive surface 60 may contact leading edges of the sheets SH supported on the sheet tray 91. A lower end of the restrictive surface 60 is located at a position lower and rightward with respect to the conveyer edge 36E of the conveyer surface 36.

The cover member 38 is arranged at an upper position with respect to the first chute member 35. The cover member 38 includes a plurality of ribs 38R that protrude downward, and lower edges of the ribs 38R form a guiding surface 38G, which virtually spreads along the lower edges of the ribs 38R. In other words, the cover member 38 includes the guiding surface 38G. A rightward part of the guiding surface 38G faces the conveyer surface 36 from above at a position displaced leftward from the conveyer edge 36E of the conveyer surface 36 in the first chute member 35. The guiding surface 38G extends to incline leftward and moderately upward along the conveyer surface 36 in the first chute member 35. A leftward part of the guiding face 38G curves along the leftward part of the conveyer surface 36 in the first chute member 35.

The conveyer surface 36 and the restrictive surface 60 in the first chute member 35, the guiding face 38G in the cover member 38, the conveyer surfaces 39G1, 39G2 in the base member 39, and the guiding surfaces 37G1, 37G2 in the second chute member 37 form a conveyance guide 30.

The conveyer surfaces 36, 39G1, 39G2, and the guiding surfaces 38G, 37G1, 37G2 extend along the conveying direction D1 and define a conveyer path, in which the sheets SH are conveyed from the sheet tray 91 to the ejection tray 96.

<Configuration of Sheet Tray>

As shown in FIGS. 1 and 3, the sheet tray 91 is supported by side frames, which are not shown but are arranged on the frontward side and the rearward side of the openable/closable body 9, to be arranged at an upper position with respect to the ejection tray 96 to vertically overlap the ejection tray 96.

The sheet tray 91 includes a sheet tray body 92 and the movable plate 50. The sheet tray body 92 extends from a rightward area in the openable/closable body 9 to incline moderately lower-leftward. The movable plate 50 is arranged to adjoin a leftward end portion of the sheet tray body 92. The movable plate 50 extends substantially in a plane toward the restrictive surface 60 in the first chute member 35.

A leftward part of the movable plate 50 is covered by a rightward part of the cover member 38 from above. The sheet tray 91 supports the sheets SH to be fed inside on the sheet tray body 92 and the movable plate 50.

The movable plate 50 is pivotably supported by side frames, which are not shown, to pivot about a pivot axis X50 extending in the front-rear direction, as shown in FIGS. 3-5. In other words, the sheet tray 91 includes the movable plate 50, which is pivotable and thereby the sheet tray 91 is movable vertically.

The movable plate 50 includes a facing end 50E. The facing end 50E forms an end of the movable plate 50 on a downstream side in the conveying direction D1 and faces the restrictive face 60.

When the movable plate 50 is at the position shown in FIG. 3, the facing end 50E faces a part of the restrictive face 60 closer to the lower end. When the movable plate 50 is at a position shown in FIG. 5, the facing end 50E faces another part of the restrictive face 60 closer to the conveyer edge 36E of the conveyer surface 36. In other words, the facing end 50E continues facing the restrictive surface 60 regardless of the pivoting movements of the movable plate 50.

The position of the movable plate 50 shown in FIG. 3 is an origin position. At a position in the vicinity of the lower end of the restrictive surface 60, arranged is an origin position sensor 59. The origin position sensor 59 may detect the movable plate 50 located at the origin position, and when the origin position sensor 59 detects the movable plate 50 located at the origin position, the origin position sensor 59 may transmit ON signals being detection signals to the controller 7. On the other hand, when the movable plate 50 moves upward from the origin position, as shown in FIGS. 4 and 5, the origin position sensor 59 may transmit OFF signals being detection signals to the controller 7.

As shown in FIGS. 1 and 3, on the movable plate 50, arranged are two width-restrictive guides 59A, 59B, which are slidable in the front-rear direction. The width-restrictive guides 59A, 59B, which are located frontward and rearward, respectively, may be moved to be closer to or farther from each other so that the width-restrictive guides 59A, 59B may flank the sheets SH to support the sheets SH steadily, regardless of a width of the sheets SH on the sheet tray 91, at a position centered about a center of the sheet tray 91 in a widthwise direction, which coincides with the front-rear direction.

<Configurations of Sheet Sensor>

As shown in FIG. 3, the automatic conveyer 4 includes a sheet sensor 58, which may detect presence and absence of the sheet SH supported on the sheet tray 91. The sheet sensor 58 includes an actuator 57 and a sensor body 58A and is located between a feed roller 41 and a separation roller 42, which will be described further below.

The actuator 57 is swingably supported at a lower end thereof to swing about a swing axis X57, which extends in the front-rear direction at a lower-leftward position with respect to the lower end of the restrictive surface 60. As the actuator 57 swings, an upper end of the actuator 57 may move in the crosswise direction between the feed roller 41 and the separation roller 42, in positions indicated in dash-and-dots lines with reference signs 57 (57A), 57 (57B), and 57 (57C) in FIG. 3. The sensor body 58A is located at a position to face the lower end of the actuator 57 and may detect a position of the actuator 57.

When no sheet SH is supported on the sheet tray 91, the actuator 57 (57A) being urged by an urging spring (not shown) may lean toward the movable plate 50 of the sheet tray 91 to project beyond the restrictive surface 60. The sensor body 58A may detect the projecting position of the actuator 57 (57A) and output ON signals being detection signals to the controller 7.

When at least one sheet SH is supported on the sheet tray 91, but the sheet SH is not being conveyed toward the conveyance guide 30, the actuator 57 (57B) being pushed by a leading edge of the sheet SH may swing leftward in FIG. 3 may stay at a position not projecting toward the movable plate 50 beyond the restrictive surface 60. Meanwhile, an upper end of the actuator 57 (57B) may project upward beyond the conveyer surface 36. The sensor body 58A may detect the position of the actuator 57 (57B) and transmit OFF signals being detection signals to the controller 7.

When the sheet SH supported on the sheet tray 91 is being conveyed toward the conveyance guide 30, the actuator 57 (57C) being pushed downward by the sheet SH may swing leftward and stay at a position not projecting beyond the conveyer surface 36, at which the actuator 57 (57C) may not interfere with the sheet SH being conveyed. The sensor body 58A may detect the position of the actuator 57 (57C) and transmit OFF signals being detection signals to the controller 7.

When the sheets SH supported on the sheet tray 91 are all fed inside from the sheet tray 91, and a final one of the sheets SH passes through the separation roller 42, which will be described further below, in other words, when no sheet SH remains on the sheet tray 91, the actuator 57 (57C) may be urged by the urging spring and swing rightward to immediately return to the position indicated by the reference sign 57 (57A) in FIG. 3. The sensor body 58A may detect the position of the returned actuator 57 (57A) and transmit ON signals being detection signals to the controller 7.

<Configuration of Tray-Driving Mechanism>

The automatic conveyer 4 includes a tray-driving mechanism 80, which may move the movable plate 50 of the sheet tray 91 vertically according to a quantity of the sheets SH placed on the sheet tray 91. The tray-driving mechanism 80 is arranged on a lower side of the movable plate 50. The tray-driving mechanism 80 includes a tray-driving source M1, a link lever 89, and a plurality of gears, which are not shown but may transmit a driving force of the tray-driving source M1 to the link lever 89.

The tray-driving source M1 may be, for example, a motor and is rotatable bidirectionally, i.e., in a normal direction and a reverse direction, under the control of the controller 7 to produce a driving force. The controller 7 may control rotating directions of the tray-driving source M1, stop the rotation of the tray-driving source M1, and control rotating velocities of the tray-driving source M1 in the normal and reverse directions.

The link lever 89 is pivotably supported to pivot about a pivot axis X89, which extends in the front-rear direction. The link lever 89 projects upper-leftward from the pivot axis X89, and a tip end of the link lever 89 contacts a downward surface of the movable plate 50.

With the tray-driving mechanism 80 that may move the movable plate 50, the movable plate 50 located at the origin position may be detected by the origin position sensor 59. The origin position sensor 59 detecting the movable plate 50 at the origin position may transmit ON signals being detection signals to the controller 7, and the controller 7 receiving the detection signals may stop the tray-driving source M1 so that the movable plate 50 may be maintained at the origin position.

As the tray-driving source M1 rotates in the normal direction, the driving force of the tray-driving source M1 may be transmitted to the link lever 89, and the link lever 89 may pivot upward and push the movable plate 50 upward. Accordingly, the movable plate 50 may pivot about the pivot axis X50 to move upward from the position shown in FIG. 3 to a position shown in FIG. 4 or further to a position shown in FIG. 5.

On the other hand, when the tray-driving source M1 rotates in the reverse direction, the driving force of the tray-driving source M1 may be transmitted to the link lever 89 so that the link lever 89 may pivot downward, and the movable plate 50 accompanying with the link lever 89 may descend. Accordingly, the movable plate 50 may pivot about the pivot axis X50 to move downward from the position shown in FIG. 5 through the position shown in FIG. 4 to return to the origin position shown in FIG. 3. The movable plate 50 of the sheet tray 91 may descend at a descending velocity V3 (see FIG. 8).

<Configuration of Feed Roller, Separation Roller, and Separation Pad>

As shown in FIG. 3, the automatic conveyer 4 includes the feed roller 41, the separation roller 42, and a separation pad 42A.

The separation roller 42 is arranged at a position on a downstream side with respect to the conveyer edge 36E of the conveyer surface 36 in the first chute member 35 in the conveying direction D1 and an upper position with respect to the conveyer surface 36. The separation pad 42A is supported by the first chute member 35 at a position directly below the separation roller 42 in an arrangement to be exposed from the conveyer surface 36. The separation pad 42A is urged toward the separation roller 42.

A rotation shaft 42S of the separation roller 42 supports a feed-roller holder 42F pivotably. The feed-roller holder 42F is swingable about a swing axis X42, which is a rotation axis of the rotation shaft 42S. The feed-roller holder 42F is arranged to extend rightward from the rotation shaft 42S over the conveyer edge 36E of the conveyer surface 36.

The feed roller 41 is retained rotatably at a rightward portion of the feed-roller holder 42F. The feed roller 41 is arranged at a position to face the movable plate 50 from above. The feed roller 41 is movable in the vertical direction along with pivoting motions of the feed-roller holder 42F about the swing axis X42.

On a leftward end of the feed-roller holder 42F, formed is a restrictive protrusion 42K protruding leftward. Meanwhile, on the cover member 38, at an upper position with respect to the restrictive protrusion 42K, formed is a restricting portion 38K being a rib protruding downward.

The restricting portion 38K may contact the restrictive protrusion 42K from above to restrict a swingable angle of the feed-roller holder 42F. Thus, a lower-limit position of the feed roller 41 may be defined. The feed roller 41 may contact the movable plate 50 of the sheet tray 91 or the sheet SH supported on the sheet tray 91 and may be uplifted by the sheet tray 91 or the sheet SH to move from the lower-limit position as shown in FIG. 3 to the position shown in FIG. 4 or FIG. 5. When the feed roller 41 is uplifted, on the other hand, the restrictive protrusion 42K may be lowered and separate from the restricting portion 38K.

As shown in FIG. 3, the origin position for the movable plate 50 of the sheet tray 91 is lower than the lower-limit position for the feed roller 41 and is a position, at which clearance to accept a largest allowable quantity of sheets SH may be reserved. In other words, the origin position for the movable plate 50 is a position, at which the sheet tray 91 may support the sheets SH.

As shown in FIG. 3, in the openable/closable body 9, at an upper position with respect to the feed-roller holder 42F, arranged is a first sensor S1. The first sensor S1 may detect whether a posture of the feed-roller holder 42F is within a predetermined range and transmit a detected result to the controller 7.

In particular, the first sensor S1 may detect the posture of the feed-roller holder 42F when a lower end of the feed roller 41 contacts an uppermost sheet SH in the sheets SH on the sheet tray 91; thereby, the first sensor S1 may indirectly detect whether a difference in height between the uppermost sheet SH and the conveyer edge 36E of the conveyer surface 36 is in a correct range, in which the uppermost sheet SH may be forwarded to the conveyer surface 36 without colliding with the conveyer edge 36E.

The feed-roller holder 42F shown in FIGS. 4 and 5 is in exemplary postures in the predetermined range. When the feed-roller holder 42F is in these postures, a height difference between the uppermost sheet SH in the sheets SH on the sheet tray 91 and the conveyer edge 36E of the conveyer surface 36 is in the correct range. Therefore, the feed roller 41 may feed the uppermost sheet SH to the conveyer surface 36 toward a position between the separation roller 42 and the separation pad 42A.

The controller 7 may determine, when the first sensor S1 detects the posture of the feed-roller holder 42F is within the predetermined range, as shown in FIG. 4 or FIG. 5, that the movable plate 50 is at a feeding position. The feeding positions shown in FIGS. 4-5 are upper positions with respect to the origin position, at which the sheet(s) SH on the sheet tray 91 may be fed to the conveyance guide 30.

FIG. 4 shows the feeding position of the movable plate 50, in which a largest allowable quantity of sheets SH are loaded on the sheet tray 91. FIG. 5 shows the feeding position of the movable plate 50, in which one (1) sheet SH is loaded on the sheet tray 91. The feeding position of the movable plate 50 may vary between the position shown in FIG. 4 and the position shown in FIG. 5, which is uplifted to a highest allowable position, depending on the quantity of the sheets SH loaded on the sheet tray 91.

<Configurations of First and Second Conveyer Rollers and Ejection Roller>

The automatic conveyer 4 includes a first conveyer roller 43, a first pinch roller 43P, a second conveyer roller 44, a second pinch roller 44P, an ejection roller 47, and an ejection pinch roller 47P.

The first conveyer roller 43 is supported by the first chute member 35, at an intermediate position in the conveyer surface 36 in the conveying direction D1. The first pinch roller 43P is supported by the cover member 38 at a position on the guiding surface 38G and is urged toward the first conveyer roller 43.

The second conveyer roller 44 is supported by the second chute member 37, at a position upstream from the second sensor S2 in the guiding surface 37G1 in the conveying direction D1. The second pinch roller 44P is supported by the base member 39 at a position on the conveyer surface 39G1 and is urged toward the second conveyer roller 44.

The ejection roller 47 is supported by the second chute member 37 at a position in a rightward end area in the guiding surface 37G2. The ejection pinch roller 47P is supported by the base member 39 at a position in a rightward end area in the conveyer surface 39G2 and is urged toward the ejection roller 47.

<Configuration of Conveyer-Driving Mechanism>

Figure 6:
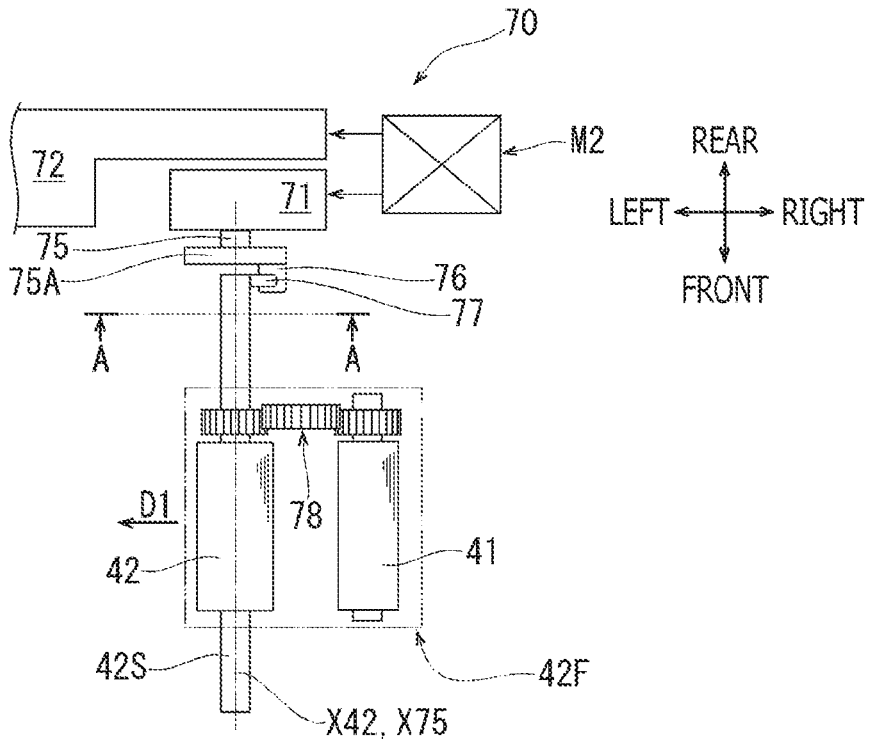
FIG. 6 is an illustrative top plan view of a conveyer-driving source, a first driving train, and a second driving train in the image reading apparatus according to the embodiment of the present disclosure.

As shown in FIG. 6, the automatic conveyer 4 includes a conveyer-driving mechanism 70, which may drive the feed roller 41, the separation roller 42, the first conveyer roller 43, the second conveyer roller 44, and the ejection roller 47. The conveyer-driving mechanism 70 includes a conveyer-driving source M2, a first driving train 71, and a second driving train 72.

The conveyer-driving source M2 may be, for example, a motor. The conveyer-driving source M2 may rotate under the control of the controller 7 to produce a driving force. The controller 7 may control the rotating and stopping movements of the conveyer-driving source M2 based on pulse signals from an encoder, which is mounted on the conveyer-driving source M2.

The first driving train 71 forms a path to transmit the driving force of the conveyer-driving source M2 to the feed roller 41 and the separation roller 42. The first driving train 71 includes the rotation shaft 42S of the separation roller 42, a transmission shaft 75 arranged closer to the conveyer-driving source M2 than the rotation shaft 42S, a disc 75A, a transmission-active portion 76, a transmission-passive portion 77, and a gear train 78. The gear train 78 is arranged closer than the rotation shaft 42S to the feed roller 41.

A transmission axis X75 of the transmission shaft 75 coincides with the swing axis X42 of the rotation shaft 42S. At a frontward end of the transmission shaft 75, the disc 75A is fixed integrally with the transmission shaft 75. Between the disc 75A and a rearward end of the rotation shaft 42S, clearance is reserved.

As shown in FIG. 6 and FIGS. 7A-7C, the transmission-active portion 76 may be a protrusion protruding frontward at an outer circumferential edge of the disc 75A. The transmission-active portion 76 may rotate integrally with the transmission shaft 75 and the disc 75A about the transmission axis X75 by the driving force of the conveyer-driving source M2 transmitted to the transmission shaft 75.

The transmission-passive portion 77 is a protrusion protruding outward in a radial direction of the transmission axis X75 from the rotation shaft 42S at a rearward end of the rotation shaft 42S and may rotate integrally with the rotation shaft 42S about the transmission axis X75. The transmission-passive portion 77 may contact the transmission-active portion 76 in a circumferential direction of the transmission axis S75.

Figure 7A:
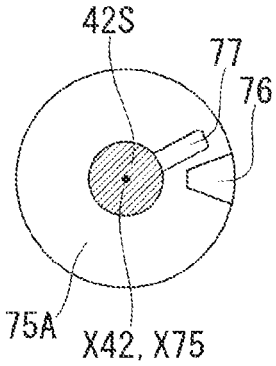
FIGS. 7A-7C are cross-sectional views viewed at a cross section A-A shown in FIG. 6 illustrating transition of positional relation between a transmission-active portion and a transmission-passive portion in the image reading apparatus according to the embodiment of the present disclosure.
Figure 7B:
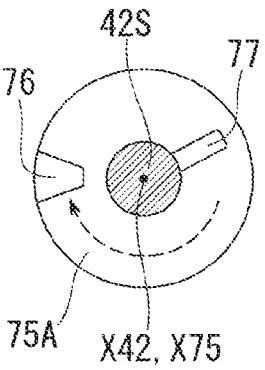
Figure 7C:
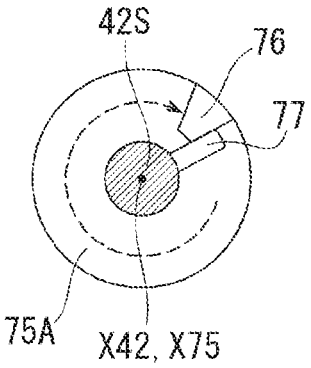

As the rotation shafts 42S rotates, as shown in FIGS. 7A-7B, the transmission-passive portion 77 may separate from the transmission-active portion 76 in the circumferential direction of the transmission axis X75. While the transmission-passive portion 77 is separated from the transmission-active portion 76, the driving force of the conveyer-driving source M2 is not transmitted to the transmission-passive portion 77. When the transmission-passive portion 77 contacts the transmission-active portion 76 in the circumferential direction of the transmission shaft X76, on the other hand, as shown in FIG. 7C, the driving force of the conveyer-driving source M2 may be transmitted to the transmission-passive portion 77, and the transmission-passive portion 77 being pushed by the transmission-passive portion 77 may start rotating passively delaying from the transmission-active portion 76 for an amount less than one lap.

As shown in FIG. 6, the gear train 78 is arranged inside the feed-roller holder 42F. The gear train 78 may transmit the rotation of the rotation shaft 42S to the feed roller 41.

Figure 8:
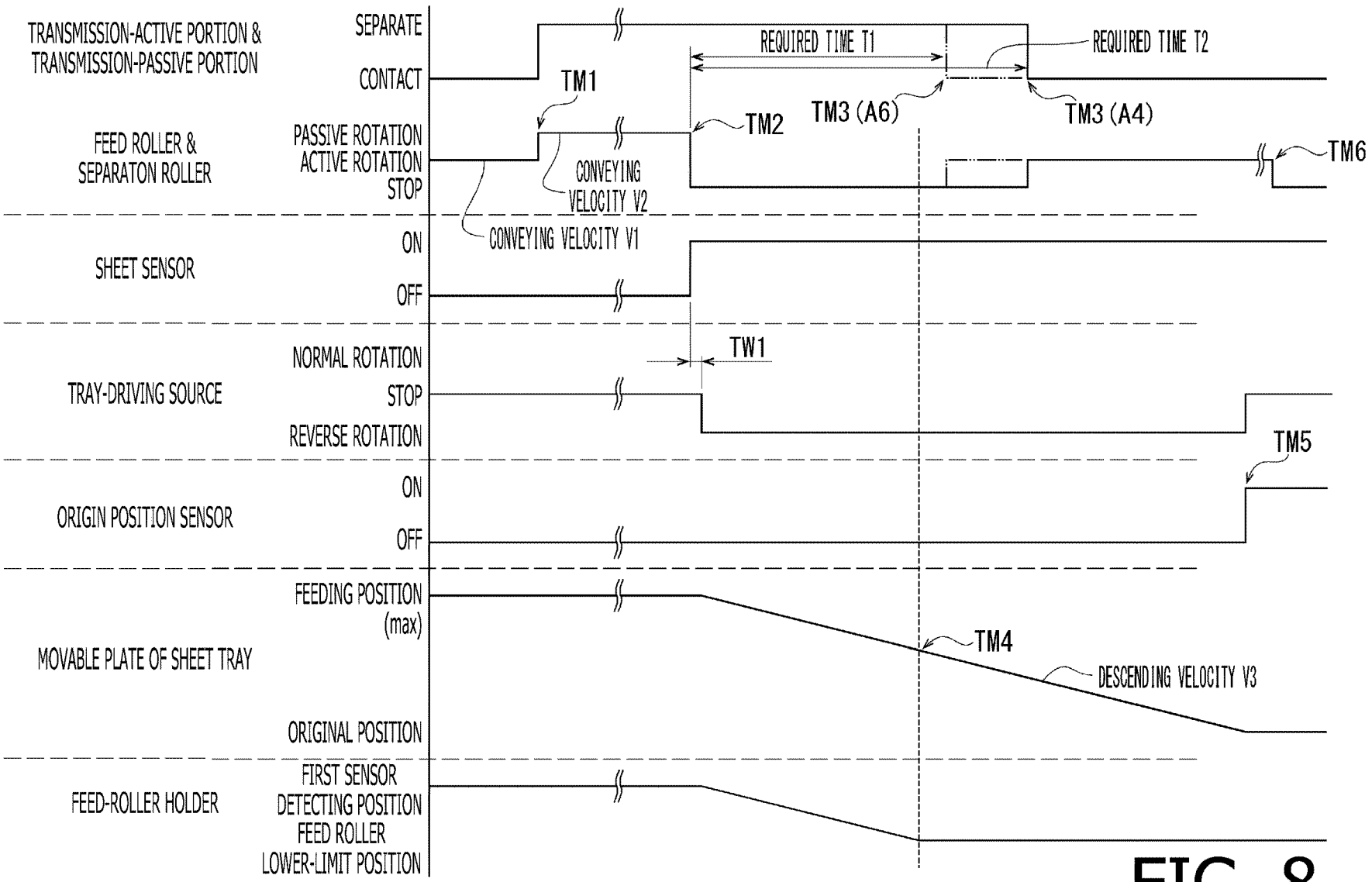
FIG. 8 is a timing chart during a specific action to be performed when a final sheet on a sheet tray is being conveyed in the image reading apparatus according to the embodiment of the present disclosure.

Thus, the feed roller 41 and the separation roller 42 may rotate by the driving force of the conveyer-driving source M2 being transmitted to the feed roller 41 and the separation roller 42 through the first driving train 71. As shown in FIG. 8, a conveying velocity to convey the sheet SH by the feed roller 41 and the separation roller 42 may be called as conveying velocity V1. In other words, the feed roller 41 and the separation roller 42 may convey the sheet SH at the conveying velocity V1.

The feed roller 41 may, as shown in FIG. 4, rotate in a direction to feed the uppermost sheet SH among the sheets SH supported on the sheet tray 91 toward the conveyer surface 36 of the conveyance guide 30.

The separation roller 42 may apply a conveying force directed downstream in the conveying direction D1 to the sheet SH that reached a nipping position between the separation roller 42 and the separation pad 42A. The separation pad 42A may, when two or more sheets SH are conveyed to the nipping position, apply a force to stop the sheet(s) SH other than the sheet SH that contacts the separation roller 42.

As illustrated in a partly omitted form in FIG. 6, the second driving train 72 forms a path to transmit the driving force of the conveyer-driving source M2 to the first conveyer roller 43, the second conveyer roller 44, and the ejection roller 47. The second driving train 72 includes a plurality of gears, which are each fixed to one of the first conveyer roller 43, the second conveyer roller 44, and the ejection roller 47, to integrally rotate with the first conveyer roller 43, the second conveyer roller 44, and the ejection roller 47, respectively.

Thus, the first conveyer roller 43, the second conveyer roller 42, and the ejection roller 47 may rotate by the driving force of the conveyer-driving source M2 being transmitted through the second driving train 72 to the first conveyer roller 43, the second conveyer roller 42, and the ejection roller 47.

A conveying velocity to convey the sheet SH by the first conveyer roller 43, the second conveyer roller 44, and the ejection roller 47 may be called as conveying velocity V2. In other words, the first conveyer roller 43, the second conveyer roller, and the ejection roller 47 may convey the sheet SH at the conveying velocity V2. In the conveyer-driving mechanism 70, a reduction rate of the first driving train 71 and a reduction rate of the second driving train 72 are in a setting such that the conveying velocity V2 is higher than the conveying velocity V1.

As shown in FIG. 4, the first conveyer roller 43 may, together with the first pinch roller 43P, nip the sheet SH separated from the other sheets SH by the separation roller 42 and the separation pad 42A and convey the separated sheet SH passed from the separation roller 42 and the separation pad 42A toward the second conveyer roller 44 and the second pinch roller 44P.

The second conveyer roller 44 may, together with the second pinch roller 44P, nip the sheet SH conveyed by the first conveyer roller 43 and the first pinch roller 43P and convey the sheet SH toward the reader surface 8B, i.e., toward the reading sensor 3S staying still at the stationary reading position.

The ejection roller 47 may, together with the ejection pinch roller 47P, nip the sheet SH passing over the reader surface 8B and being guided by the conveyer surface 39G2 and the guiding surface 37G2 and eject the sheet SH at the ejection tray 96.

While the conveyer-driving source M2 is in motion, the transmission-active portion 76 and the transmission-passive portion 77 in the first driving train 71 may repeat contacting and separating from each other. Therefore, the feed roller 41 and the separation roller 42 may shift first through third states in circulation: a first state, in which the feed roller 41 and the separation roller 42 convey the sheet SH from the sheet tray 91 along the conveyance guide 30 at the conveying velocity V1; a second state, in which the feed roller 41 and the separation roller 42 are rotated passively by the sheet SH being nipped and pulled by the first conveyer roller 43 at the conveying velocity V2; and a third state, in which the feed roller 41 and the separation roller 42 stop rotating due to separation of the sheet SH being pulled by the first conveyer roller 43 from the feed roller 41 and the separation roller 42. In the first state, the transmission-active portion 76 and the transmission-passive portion 77 being pushed by the transmission-active portion 76 rotate integrally, as shown in FIG. 7C. In the second state, the transmission-passive portion 77 rotates at the conveying velocity V2, and the transmission-active portion 76 rotates at the conveying velocity V1; therefore, the transmission-passive portion 77 separates gradually farther from the transmission-active portion 76, and a circumferential distance between the transmission-passive portion 77 and the transmission-active portion 76 gradually increases. In the third state, after the sheet SH leaves the separation roller 42, the transmission-passive portion 77 stops rotating. However, in order to continue conveyance of the sheets SH, rotation of the transmission-active portion 76 is maintained. In the meantime, the driving force of the conveyer-driving source M2 may not be transmitted to the transmission-passive portion 77 until the transmission-active portion 76 catches up and contacts the transmission-passive portion 77. Therefore, until the transmission-active portion 76 contacts the transmission-passive portion 77, feeding of the next sheet SH may not start. Accordingly, as the sheets SH are fed one after another from the sheet tray 91, a distance may be securely reserved between the sheets SH.

The memory 7M may store information concerning a required time T1. The required time is a time period between timing, at which a trailing end of a smallest allowable-sized sheet SH, e.g., A6-sized sheet SH, passes through the separation roller 42, and timing, at which the transmission-passive portion 77 caught up and pushed by the transmission-active portion 76 starts rotating passively. For example, the memory 7M may store a count from the encoder in the conveyer-driving source M2.

As shown in FIG. 8, the required time T1 is a period between timing TM2 and timing TM3 (A6). A time period, in which the transmission-active portion 76 and the transmission-passive portion 77 in the first driving train 76 are separated, may depend on a time period, in which the sheet SH nipped by the first conveyer roller 43 is conveyed at the conveying velocity V2. In other words, a conveying distance for the sheet SH to be conveyed while the transmission-active portion 76 and the transmission-passive portion 77 in the first driving train 76 are separated may depend on a conveying distance, in which the sheet SH nipped by the first conveyer roller 43 is conveyed at the conveying velocity V2. Therefore, when the sheet SH supported on the sheet tray 91 is an A4-sized sheet SH, which is larger than the A6-sized sheet SH, a required time T2 between timing, at which a trailing end of the A4-sized sheet SH passes through the separation roller 42, and timing, at which the transmission-passive portion 77 starts rotating by being caught up and pushed by the transmission-active portion 76, is longer than the required time T1. In other words, the required time T2 between the timing TM2 and the timing TM3 (A4) is longer than the required time T1.

<High-Velocity Processing Mode and Low-Velocity Processing Mode>

The controller 7 may select a processing mode for an image reading operation to read an image of the sheet SH being conveyed by the automatic conveyer 4 between a high-velocity processing mode, in which the image reading operation may be performed at a predetermined velocity, and a low-velocity processing mode, in which the image reading operation may be performed at a velocity lower than the predetermined velocity. In the low-velocity processing mode, a quality to read an image may be higher.

When the controller 7 selects the high-velocity processing mode, the controller 7 may control a rotation frequency of the conveyer-driving source M2 in the conveyer-driving mechanism 70 to drive the first conveyer roller 43, the second conveyer roller 44, and the ejection roller 47 at the conveying velocity V2 set at a first processing velocity V2A (V2=V2A).

On the other hand, when the controller 7 selects the low-velocity processing mode, the controller 7 may control the rotation frequency of the conveyer-driving source M2 in the conveyer-driving mechanism 70 to be lower than the rotation frequency in the high-velocity processing mode to drive the first conveyer roller 43, the second conveyer roller 44, and the ejection roller 47 at the conveying velocity V2 set at a second processing velocity V2B (V2=V2B). The second processing velocity V2B is lower than the first processing velocity V2A.

Moreover, the controller 7 may control a descending velocity V3, which is a velocity to move the movable plate 50 of the sheet tray 91 downward, depending on the selection between the high-velocity processing mode and the low-velocity processing mode.

In particular, when the controller 7 selects the high-velocity processing mode, the controller 7 may control the rotation frequency of the tray-driving source M1 in the tray-driving mechanism 80 to move the movable plate 50 at the descending velocity V3 set at a first descending velocity V3A (V3=V3A).

On the other hand, when the controller 7 selects the low-velocity processing mode, the controller 7 may control the rotation frequency of the tray-driving source M1 in the tray-driving mechanism 80 to be lower than the rotation frequency in the high-velocity processing mode to move the movable plate 50 at the descending velocity V3 set at a second descending velocity V3B (V3=V3B). The second descending velocity V3B is lower than the first descending velocity V3A. The descending velocity V3 may be switched not only upon selection of the processing mode but also in a specific action, which will be described further below.

<Image Reading Action to Original Document Supported on the Document Supporting Surface>

When the image reading apparatus 1 described above reads an image of an original document supported on the document supporting surface 8A, the controller 7 may control the scanner-driving source 3M in the reader unit 3 to operate a scanner device, which is not shown, to move the reading sensor 3S in the crosswise direction from a read-start position located underneath a leftward edge of the document supporting surface 8A to a read-end position located underneath a rightward edge of the document supporting surface 8A. Meanwhile, the reading sensor 3S may read an image of the original document supported on the document supporting surface 8A. Thereafter, the controller 7 may control the scanner-driving source 3M in the reader unit 3 to operate the scanner device to move the reading sensor 3S that finished reading in a reverse direction to move from the rightward end to the leftward end and return to a reading-standby position.

<Image Reading Action and Specific Action to Original Document being Conveyed by the Automatic Conveyer>

The image reading apparatus 1 may convey the sheet SH supported on the sheet tray 91 by the automatic conveyer 4 and read an image of the sheet SH being conveyed. In particular, the controller 7 may control the scanner-driving source 3M of the reader unit 3 to operate the scanner device to place the reading sensor 3S at the stationary reading position located underneath the reader surface 8B, as shown in FIG. 3. At this point, the movable plate 50 is located at the origin position, and the sheet sensor 58 may detect a sheet SH on the sheet tray 91 and transmit an OFF signal to the controller 7.

Next, when the high-velocity processing mode is selected, the controller 7 may set the conveying velocity V2 at the first processing velocity V2A and the descending velocity V3 at the first descending velocity V3A. On the other hand, when the low-velocity processing mode is selected, the controller 7 may set the conveying velocity V2 at the second processing velocity V2B and the descending velocity V3 at the second descending velocity V3B.

Next, the controller 7 may rotate the tray-driving source M1 in the normal direction to swing the link lever 89 upward and uplift the movable plate 50 from the origin position toward the feeding position.

When the controller 7 determines, based on the detection signals from the first sensor S1, that the movable plate 50 reached the feeding position, the controller 7 may stop the rotation of the tray-driving source M1. Thereby, a difference in height between the uppermost sheet SH and the conveyer edge 36E of the conveyer surface 36 may stay within a correct range.

Next, the controller 7 may activate the conveyer-driving source M2 to drive the feed roller 41, the separation roller 42, the first conveyer roller 43, the second conveyer roller 44, and the ejection roller 47 to convey the sheets SH on the sheet tray 91 one by one along the conveyance guide 30.

Thereby, the transmission-active portion 76 and the transmission-passive portion 77 in the first driving train 71 repeat contacting and separating from each other, and the sheets SH fed one by one from the sheet tray 91 may be securely distanced from one another.

When the sheet SH being conveyed along the conveyer surfaces 36, 39G1, 39G2 passes over the reader surface 8B, the controller 7 may control the reading sensor 3S staying still at the stationary reading position to read the image of the sheet SH. The controller 7 may operate the ejection roller 47 and the ejection pinch roller 47P to nip the sheet SH, whose image has been read, to eject the sheet SH at the ejection tray 96.

In particular, the controller 7 may control timing for the reading sensor 3S to read the image based on timing, at which the second sensor S2 detects the leading edge of the sheet SH being conveyed along the conveyance guide 30, and the conveying velocity V2 for the sheet SH. Moreover, the controller 7 may determine a length of the sheet SH being conveyed and timing, at which the ejection roller 47 may eject the sheet SH completely, based on a required time between timing, at which the leading edge of the sheet SH being conveyed along the conveyance guide 30 is detected by the second sensor S2, and timing, at which the trailing edge of the same sheet SH is detected by the second sensor S2, and the conveying velocity V2 for the sheet SH.

During this operation, the controller 7 may control the tray-driving source M1 to rotate intermittently, based on the detection signals from the first sensor S1 and the reduced amount of the sheets SH on the sheet tray 91, to cause the movable plate 50 to pivot upward little by little in small motions so that the posture of the feed-roller holder 42F may be maintained in the predetermined range.

When the amount of the sheets SH on the sheet tray 91 is reduced to a final one of the sheets SH, as shown in FIG. 5, the final sheet SH may be fed and conveyed along a timeline as shown in FIG. 8.

When conveyance of the final sheet SH starts, the transmission-active portion 76 contacts the transmission-passive portion 77, as shown in FIGS. 7C and 8, and the transmission-passive portion 77 is pushed by the transmission-active portion 76. Thereby, as shown in FIG. 8, the feed roller 41 and the separation roller 42 rotate to convey the sheet SH at the conveying velocity V1.

Meanwhile, the sheet sensor 58 detecting the sheet SH being conveyed but partly supported on the sheet tray 91 is transmitting OFF signals to the controller 7. The tray-driving source M1 stays motionless. The original sensor 5 is transmitting OFF signals to the controller 7. The feeding position for the movable plate 50 of the sheet tray 91 is at the upper-limit position, as shown in FIGS. 5 and 8. The feed-roller holder 42F is located at the position to be detected by the first sensor S1, as shown in FIGS. 5 and 8.

At timing TM1, as shown in FIG. 8, the sheet SH conveyed by the separation roller 42 is passed to the first conveyer roller 43, and the sheet SH is conveyed at the conveying velocity V2. Accordingly, the feed roller 41 and the separation roller 42 are rotated by the sheet SH being pulled, and the transmission-passive portion 77 separates from the transmission-active portion 76 leaving the transmission-active portion 76 behind.

Next, at timing TM2, the final sheet SH leaves the separation roller 42, the transmission-passive portion 77 stops rotating, and the feed roller 41 and the separation roller 42 stop rotating. Meanwhile, the transmission-active portion 76 left behind from the transmission-passive portion 77 rotates to run after the transmission-passive portion 77. In this arrangement, the separation roller 41 staying motionless contacts the movable plate 50 of the sheet tray 91 directly. Meanwhile, the sheet sensor 58 detects absence of the sheet SH on the sheet tray 91 and transmits ON signals to the controller 7.

Moreover, at timing TM2, the controller 7 calculates a tray descending-start time TW1, which may be referred to in order to determine timing to start the specific action. The specific action is an action to move the movable plate 50 of the sheet tray 91 downward from the uppermost feeding position by controlling the tray-driving source M1 in the tray-driving mechanism 80. The controller 7 may read the required time T1, the descending velocity V3, and information concerning a distance for the movable plate 50 to pass through the lower-limit position for the feed roller 41 from the memory 7M to calculate the tray descending-start time TW1. The tray descending-start time TW1 is a time period, in which, when the movable plate 50 descends at the descending velocity V3, the feed roller 41 should separate from the movable plate 50 before the transmission-passive portion 77 is pushed by the transmission-active portion 76 and starts rotating. The tray descending-start time TW1 is shorter than the required time T1.

After a lapse of the tray descending-start time TW1 since timing TM2, the controller 7 rotates the tray-driving source M1 in the reverse direction. Thereby, the movable plate 50 of the sheet tray 91 moves downward at the descending velocity V3. Moreover, the feed-roller holder 42F descends along with the movable plate 50 as long as the feed roller 41 stays in contact with the movable plate 50.

As the movable plate 50 descends, at timing TM4, the movable plate 50 passes through the lower-limit position for the feed roller 41 and descends further. In the meantime, the restrictive protrusion 42K reaches the restricting portion 38K, and the feed-roller holder 42F is restricted by the restricting portion 38K from swinging further. Thereby, the feed-roller holder 42F maintains the feed roller 41 at the lower-limit position. As a result, the feed roller 41 is separated from the movable plate 50.

Timing TM 4 is, when, for example, the sheet SH supported on the sheet tray 91 is an A4-sized sheet, set to arrive substantially earlier than timing TM3 (A4), at which the transmission-passive portion 77 starts rotating by being pushed by the transmission-active portion 76 after the trailing end of the A4-sized sheet SH passes through the separation roller 42.

When, for another example, the sheet SH supported on the sheet tray 91 is an A6-sized sheet, timing TM4 is set to arrive substantially earlier than timing TM3 (A6), at which the transmission-passive portion 77 starts rotating by being pushed by the transmission-active portion 76 after the trailing end of the A4-sized sheet SH passes through the separation roller 42.

Next, at timing TM5, when the origin position sensor 59 detects the movable plate 50 moved to the origin position, the origin position sensor 59 transmits ON signals to the controller 7, and the controller 7 stops the tray-driving source M1 and ends the specific action.

Moreover, at timing TM6, when the ejection roller 47 completely ejects the final sheet SH, the controller 7 stops the conveyer-driving source M2 to stop the rotation of the feed roller 41, the separation roller 42, the first conveyer roller 43, the second conveyer roller 44, and the ejection roller 47. Thereafter, the controller 7 controls the scanner-driving source 3M in the reader unit 3 to operate the scanner device to move the reading sensor 3S to return to the sensor-standby position to finish the image reading operation.

<Benefits>

According to the image reading apparatus 1 in the embodiment described above, as shown in FIGS. 6 and 7A-7C, the conveyer-driving mechanism 70 has the transmission-active portion 76 and the transmission-passive portion 77. The conveying velocity V2 of the sheet SH conveyed by the first conveyer roller 43, the second conveyer roller 44, and the ejection roller 47 is set to be higher than the conveying velocity V1 to convey the sheet SH by the feed roller 41 and the separation roller 42. Therefore, when the sheet SH conveyed by the separation roller 42 is passed to the first conveyer roller 43, the feed roller 41 and the separation roller 42 are driven passively through the sheet SH to rotate, causing the transmission-passive portion 77 to precede the transmission-active portion 76.

Thereafter, when the sheet SH leaves the separation roller 42, the separation roller 42 is no longer pulled by the sheet SH, and the feed roller 41 and the separation roller 42 stop rotating. Meanwhile, the transmission-active portion 76 rotate to catch up the transmission-passive portion 77. When the transmission-active portion 76 reaches the transmission-passive portion 77, the transmission-passive portion 77 is pushed by the transmission-active portion 76 to rotate passively along with the transmission-active portion 76. Therefore, the feed roller 41 and the separation roller 42 resume rotating, and the next sheet SH is conveyed. Thus, the sheets SH being conveyed are securely distanced from one another. In this instance, the feed roller 41 resuming rotation may not slip on the sheet SH staying motionless on the sheet tray 91 easily; therefore, noise and friction that may otherwise be produced when the feed roller 41 slips on the sheet SH being in motion may be restrained effectively.

According to the image reading apparatus 1 in the embodiment described above, moreover, after the final sheet SH leaves the separation roller 42, the sheet sensor 58 may detect no sheet SH remaining on the sheet tray 91 at timing TM2 shown in FIG. 8. Thereafter, after the lapse of the tray descending-start time TW1, which is shorter than the predetermined time period, and before the transmission-passive portion 77 pushed by the transmission-active portion 76 starts rotating passively, the controller 7 may conduct the specific action to move the movable plate 50 of the sheet tray 91 downward by controlling the tray-driving source M1 in the tray-driving mechanism 8. Therefore, the pressure by the feed roller 41 against the movable plate 50 of the sheet tray 91 may be reduced, or cleared to none. Therefore, while the feed roller 41 resumes rotating at timing TM3 before conveyance of the final sheet SH is completed at timing TM6, noise and friction that may otherwise be produced when the feed roller 41 slips on the movable plate 50 of the sheet tray 91 may be restrained effectively.

Therefore, the noise may be reduced or restrained, and endurance may be improved in the image reading apparatus 1 according to the embodiment.

According to the image reading apparatus 1 in the embodiment described above, moreover, the restricting portion 38K may restrict the swingable angle of the feed-roller holder 42F, as shown in FIG. 4, to define the lower-limit position for the feed roller 41. In this arrangement, the controller 7 conducting the specific action may move the movable plate 50 of the sheet tray 91 to the position lower than the lower-limit position for the feed roller 41, as shown in FIG. 8. Therefore, through the specific action, the movable plate 50 of the sheet tray 91 may be separated from the feed roller 41, and the pressure by the feed roller 41 against the movable plate 50 of the sheet tray 91 may be reduced to none. As a result, while the feed roller 41 resumes rotating at timing TM3 before the final sheet SH is conveyed completely at timing TM6, noise and friction that may otherwise be produced when the feed roller 41 slips on the movable plate 50 of the sheet tray 91 may be restrained more effectively.

According to the image reading apparatus 1 in the embodiment described above, moreover, the controller 7 conducting the specific action may move the movable plate 50 of the sheet tray 91 to the origin position. Therefore, when the sheets SH on the sheet tray 91 are all consumed, and no sheet SH remains on the sheet tray 91, a user may not need to wait for the movable plate 50 to return to the origin position but start refilling sheets SH on the sheet tray 91 more promptly.

According to the image reading apparatus 1 in the embodiment described above, moreover, the controller 7 may, based on the information related to the predetermined time T1 stored in the memory 7M, calculate the tray descending-start time TW1, which is shorter than the predetermined time T1, and after the tray descending-start time TW1 elapses, the controller 7 may start the predetermined action. Thus, the specific action may be performed reliably before the feed roller 41 resumes rotating at timing TM3 while sheets SH in different sizes may be conveyed.

According to the image reading apparatus 1 in the embodiment described above, moreover, for the descending velocity V3 to move the movable plate 50 of the sheet tray 91 downward, the controller 7 may set the first descending velocity V3A when the high-velocity processing mode is selected or may set the second descending velocity V3B, which is lower than the first descending velocity V3A, when the low-velocity processing mode is selected. Therefore, in the low-velocity processing mode, which may be selected when a higher image-reading quality rather than faster processing speed is required, vibration that may be produced when the tray-driving mechanism 80 moves the movable plate 50 downward may be moderated and restrained from being transmitted to the first conveyer roller 43, the second conveyer roller 44, or the ejection roller 47. Accordingly, in the low-velocity processing mode in the image reading apparatus 1, the first conveyer roller 43, the second conveyer roller 44, and the ejection roller 47 may convey the sheet SH including the final sheet SH steadily at the conveying velocity V2 until conveyance of the final sheet SH is completed at timing TM6. Therefore, the conveying velocity V2, at which the sheet SH is conveyed by the first conveyer roller 43, the second conveyer roller 42, and the ejection roller 47, may be restrained from fluctuating before conveyance of the final sheet SH is completed at timing TM6, and an influence by the fluctuation on the accuracy to read the image of the sheet SH may be restrained.

Although an example of carrying out the invention has been described, those skilled in the art will appreciate that there are numerous variations and permutations of the sheet conveyer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the separation pad 42A to work with the separation roller 42 may be replaced with a retard roller.

For another example, timing TM4 may be set to arrive later than timing TM3 (A6) while the reminder of the configuration of the sheet conveyer may be similar to that of the sheet conveyer in the embodiment described above.

For another example, if the influence by the vibration of the movable late 50 in the low-velocity processing mode is considered to be substantially small, the descending velocity V3 may be maintained at the first descending velocity V3A, and the tray descending-start time TW1 may be extended to be longer than the tray descending-start time TW1 in the high-velocity processing mode.

For another example, it may not necessarily be limited to the movable plate 50 being a part of the sheet tray 91 that moves vertically, but the entire sheet tray may move vertically.

For another example, the sheet conveyer may not necessarily be applied to the single-functioned image reading apparatus but may be included in a multifunction peripheral machine having a plurality of image processing functions.

What is claimed is:

1. A sheet conveyer, comprising:

a sheet tray configured to support sheets for being fed;

a tray-driving linkage configured to move the sheet tray vertically according to a quantity of the sheets supported by the sheet tray;

a conveyance guide configured to guide the sheets fed from the sheet tray;

a feed roller configured to feed the sheets supported by the sheet tray along the conveyance guide;

a separator configured to separate the sheets fed by the feed roller from one another and convey the sheets separately along the conveyance guide;

a conveyer configured to convey the sheets passed from the separator;

a conveyer-driving mechanism configured to drive the feed roller, the separator, and the conveyer;

a controller configured to control the tray-driving linkage and the conveyer-driving mechanism; and a sheet sensor located between the feed roller and the separator, the sheet sensor being configured to detect presence and absence of the sheets supported by the sheet tray, wherein the conveyer-driving mechanism includes a transmission-active portion and a transmission-passive portion, the transmission-active portion and the transmission-passive portion being arranged in a path to transmit a driving force from a driving source to the feed roller and the separator, the conveyer-driving mechanism being configured to drive the feed roller, the separator, and the conveyer in a setting such that a conveying velocity to convey the sheets by the conveyer is higher than a conveying velocity to convey the sheets by the feed roller and the separator;

wherein the transmission-active portion is configured to be driven to rotate about a transmission axis;

wherein the transmission-passive portion is configured to be driven to rotate about the transmission axis, the transmission-passive portion being configured to contact the transmission-active portion along a circumferential direction of the transmission axis, the transmission-passive portion being configured to start rotating passively by being pushed by the transmission-active portion; and wherein the controller is configured to, after the sheet sensor detects absence of the sheets supported by the sheet tray, and before the transmission-passive portion starts rotating passively, conduct a specific action to move the sheet tray downward by controlling the tray-driving linkage.

2. The sheet conveyer according to claim 1, further comprising:

a feed-roller holder configured to support the feed roller rotatably, the feed-roller holder being swingable about a swing axis; and a restrictive portion configured to define a lower-limit position for the feed roller by restricting a swingable angle of the feed-roller holder, wherein the controller conducting the specific action controls the sheet tray to move to a position lower than the lower-limit position.

3. The sheet conveyer according to claim 2, wherein the sheet tray is movable to an origin position, at which the sheets are accepted to be supported by the sheet tray, the origin position being lower than the lower-limit position; and wherein the controller conducting the specific action controls the sheet tray to move to the origin position.

4. The sheet conveyer according to claim 1, further comprising a memory configured to store information concerning a required time, the required time being between timing, at which a smallest allowable-sized sheet to be supported by the sheet tray passes through the separator, and timing, at which the transmission-passive portion contacting the transmission-active portion starts rotating passively, wherein the controller starts conducting the specific action based on the information concerning the required time read from the memory.

5. The sheet conveyer according to claim 1, wherein the controller is configured to select one of:

a high-velocity processing mode, in which the controller controls the conveyer-driving mechanism to drive the conveyer at a first processing velocity; and a low-velocity processing mode, in which the controller controls the conveyer-driving mechanism to drive the conveyer at a second processing velocity lower than the first processing velocity, wherein, when the controller selects the high-velocity processing mode, the controller conducting the specific action controls the tray-driving linkage to move the sheet tray downward at a first descending velocity, but when the controller selects the low-velocity processing mode, the controller conducting the specific action controls the tray-driving linkage to move the sheet tray downward at a second descending velocity lower than the first descending velocity.

6. The sheet conveyer according to claim 1, wherein the tray-driving linkage includes a motor, a link lever being pivotable and having a tip end which contacts a downward surface of the sheet tray, and a plurality of gears configured to transmit a driving force of the motor to the link lever.

* * * * *